US006490769B2

(12) United States Patent
Siegel

(10) Patent No.: US 6,490,769 B2
(45) Date of Patent: Dec. 10, 2002

(54) SLIDER FOR A CLOSING BAND, ADVANTAGEOUSLY OF PLASTIC

(75) Inventor: Karl-Heinz Siegel, Nuremburg (DE)

(73) Assignee: ASF Verwaltungs GmbH, Altdorf (DE)

( * ) Notice: Subject to any disclaimer, the term of this patent is extended or adjusted under 35 U.S.C. 154(b) by 0 days.

(21) Appl. No.: 09/852,791

(22) Filed: May 11, 2001

(65) Prior Publication Data

US 2001/0039698 A1 Nov. 15, 2001

(30) Foreign Application Priority Data

May 11, 2000 (DE) ..... 100 23 059

(51) Int. Cl.[7] ..... A44B 19/26; B65D 33/24

(52) U.S. Cl. ..... 24/415; 24/399; 24/400; 24/437; 24/587; 383/64

(58) Field of Search ..... 24/415, 416, 417, 24/387, 390, 437, 587; 383/63, 64

(56) References Cited

U.S. PATENT DOCUMENTS

| | | | | | |
|---|---|---|---|---|---|
| 3,426,396 A | * | 2/1969 | Laguerre | ..... | 24/437 |
| 5,007,142 A | * | 4/1991 | Herrington | ..... | 24/400 |
| 5,010,627 A | * | 4/1991 | Herrington | ..... | 24/400 |
| 5,283,932 A | * | 2/1994 | Richardson et al. | ..... | 24/400 |
| 5,871,281 A | * | 2/1999 | Stolmeier et al. | ..... | 383/64 |
| 6,059,456 A | * | 5/2000 | May | ..... | 383/63 |

FOREIGN PATENT DOCUMENTS

| | | | | |
|---|---|---|---|---|
| DE | 1 632 574 | | 2/1968 | |
| DE | 2 101 875 | | 1/1971 | |
| DE | 31 36 075 | | 9/1981 | |
| EP | 0479661 | * | 4/1992 | ..... 24/415 |
| EP | 0511616 | * | 11/1992 | ..... 24/415 |
| WO | 95/35057 | | 6/1995 | |

* cited by examiner

*Primary Examiner*—Victor Sakran
(74) *Attorney, Agent, or Firm*—Jacobson Holman PLLC

(57) ABSTRACT

A slider for a closing band includes a core piece (8), two parallel inner surfaces (31, 32), and two support flanks (14, 15). In order improved sliders of this kind, an additional core piece (7) is provided (FIG. 2) in the region of the inner surfaces (31, 32).

20 Claims, 4 Drawing Sheets

SLIDER FOR A CLOSING BAND, ADVANTAGEOUSLY OF PLASTIC

BACKGROUND OF THE INVENTION

1. Field of the Invention

The invention concerns a slider for a closing band. It also concerns a closing band with a slider of this kind and a purse, advantageously of plastic, with a closing band of this kind.

2. Description of the Related Art

Sliders and closing bands of this kind, which can also be called profile closers or slider-closing strips or bands, are already known. Most of the known sliders are produced simply by the injection-molding process and then applied individually to the slider-closing bands by means of complicated automatic devices. With most of these sliders, it is necessary to apply them by means of so-called vibrating pots—oriented in the assembly direction—of a device that spreads the slider and then presses it across the closing band, which has been opened previously.

Such a device is known, for example, from DE-OPS 31 36 075. Here, a series of sliders is directed to a rotor, which grasps the upper part of the slider, while the side parts (wings) of the slider are spread slowly in a stator and then pushed by the rotor onto the slider-closing band.

Other systems use complicated foldable sliders, the side parts (wings) of which are horizontal and are closed onto the band in the manner of a hinge. A slider of this kind is known from PCG/WE 95/35057.

All these methods have the disadvantage that, on the one hand, production of the slider is costly and, on the other hand, assembly of the slider requires complicated devices, which are very susceptible to breakage and permit only relatively slow production.

Sliders and a process for applying them are known from DE-PS 16 32 574, in which the U-shaped sliders are placed across slider-closing strips. The closing strips, which form and continuous strip, are moved in steps, and thereby one slider at a time is pressed onto a stationary closing band by means of a tappet.

DE-OS 21 01 875 describes a device for applying sliders to complementary closing elements, which slide by the device intermittently, whereby one slider at a time from an endless chain of elastic sliders is pressed from the chain onto the band. The side parts (wings) of the sliders bend elastically, so that they spring back after being spread and pressed lightly and make the slider capable of functioning. With this method, production is possible with few disturbances and a relatively high speed. There is an essential disadvantage, however, in that the slider can be grasped by the user only under certain conditions, because of its small size. They are not very convenient and can be ripped down when the closing band is handled roughly. Another disadvantage is that these sliders have a very short arrow-shaped core in the front part only, with flanks that project inward. By holding the profile parts of the closing band, these flanks prevent the slider from being pulled upward, but only in the front third of the slider. Although there are small flanks projecting inward at the end of the slider, which enclose the closing band from the outside and prevent the slider from being pulled or tilted away, they are so short that they can slide over the profile of the closing band already with a little force, and the upper part of the slider then tilts upward. In this way, the closing function of the slider is no longer provided.

SUMMARY OF THE INVENTION

The task of the invention is to recommend an improved slider for a closing band.

This task is solved by a slider, advantageously made of plastic, which includes a core piece, two inner surfaces running parallel to each other, and two support flanks. The slider can have essentially the shape of a U. In this case, it consists of a base part and two side parts or wings connected to it. The closing band, which consists advantageously of plastic, generally includes two parts or partial bands with profiles that can mesh with one another. The slider serves to make the meshing profiles or parts of the closing band fit together by sliding or pushing or to separate them. The meshing parts of the closing band are moved toward each other by means of the parallel inner surfaces of the slider. This is achieved by the decreasing distance between the inner surfaces of the slider. At one end of these inner surfaces, a core piece is provided, by means of which the meshing parts are kept at a distance. At the other end, the inner surfaces of the slider are provided with support flanks. In this region, the meshing parts are fit together: the closing band is hooked or closed.

According to the invention, another core piece is provided in the region of the inner surfaces of the slider. This advantageously involves a relatively small core piece or a core piece that is smaller that the actual core piece. The additional core piece is located between the inner surfaces of the slider. It is also located between the actual core piece and the support flanks. The additional core piece holds both profile parts with its side flanks of the slider-closing band securely tight, even as far as the middle part of the slider, and prevents the end of the slider from tilting upward. According to the invention, the halves of the slider-closing band accepted by the narrower end of the slider. The closing band, now closed, is then held by the smaller support flanks. When the side parts of the slider are to be bent away from each other slightly by a force, for example by pulling, the slider is prevented from tilting upward at its end, since the additional core piece in the middle of the slider holds the closing band tight.

With the invention, a slider is provided, by means of which the disadvantages described in the introduction are avoided the slider has a usual size. It is therefore easy to produce in a chain, so that rapid production is possible with few disturbances. With the invention, the disadvantages of the slider being tilted away too easily in the bottom part is prevented by having two separate core pieces with guide flanks arranged one behind the other. Moreover, the bending elasticity required for operation of the slider is defined for each plastic used. Finally, the invention includes an improvement to the process for applying an endless chain of sliders onto a closing band.

Advantageously, the additional core piece is connected to the other core piece. The connection is made advantageously through a bridge. It is advantageously to provide a thin bridge.

According to another advantageous further development, additions are provided on the upper side of the slider. When the slider has a U shape, the additions are advantageously located on the base part, specifically on the side of the base part opposite the side walls or wings. The additions serve to press or spread the slider the slider when the slider is applied to a closing band.

The slider is advantageously made of HDPE, thus a low-pressure polyethylene (high density polyethylene). HDPE can be produced with high pressure polyethylene (low density polyethylene, LDPE), from which most bags or purses are produced and which recycle well, but also with polypropylene, from which purses are closing bands are being produced increasingly.

The invention also concerns a closing band, advantageously of plastic, that has a slider according to the invention, and a purse, advantageously of plastic, that is characterized by a closing band according to the invention.

Embodiment examples of the invention will be explained below with reference to the attached drawings. In the drawings:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
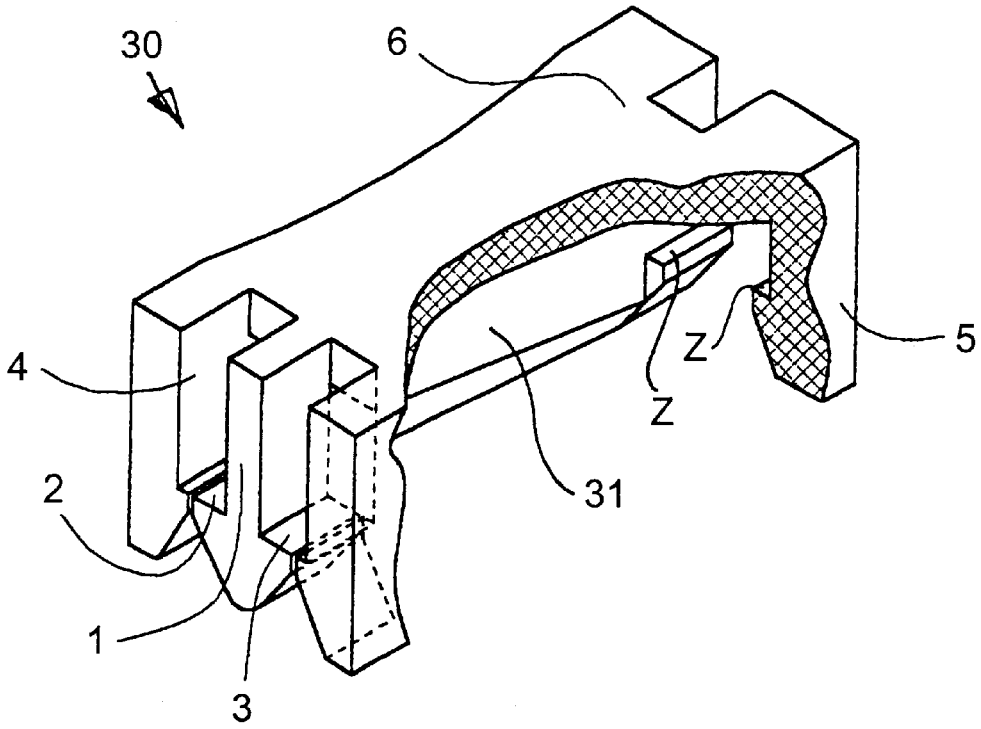
FIG. 1 (PRIOR ART)
FIG. 1 shows a slider according to DE-OS 16 32 574 in a perspective view.

FIG. 1 shows a slider of the known type in a perspective view. The slider 30 is essentially in the shape of a U. It has a base part 6 and two side parts 4 and 5 at a distance from it, which can also be called wings. The inner surfaces 31, 32 of the side parts 4, 5 run at a decreasing distance to from each other in a direction opposite to the direction of the arrow 33.

A core piece 1 is arranged at one end of the inner surfaces 31, 32. It is located at the end of the slider at which the distance of the inner surfaces 31, 32 is greatest. The core piece 1, which is shaped as an arrow pointing downward, has side flanks 2, 3, which, together with smaller flanks on the side walls 4, 5 and the side walls 4, 5 and the corresponding side walls of the core piece 1 form inlet channels, separated from each other, for the closing profile parts.

At the other end of the inner surfaces 31, 32, support flanks are provided, which project inward from the inner surfaces 31, 32 and form an outlet channel together with the inner surfaces.

The slider 30 is pressed downward only a closing band. With this, the side walls 4, 5 give way outward, until the closing ban is in the slider. In this position, one closing profile runs through each of the two inlet channels on both sides of the core piece 1. At the other end of the slider, the locked or fitted closing bands run through the outlet channel.

In the slider of the known type shown in FIG. 1, the flanks 2, 3 of the core piece 1 are only very short. These flanks 2, 3, together with the sides of the side walls 4, 5, hold the slider tight in its front part on the slider-closing profile. Tho other end of the slider, which faces the core piece 1 is tapered and pressed the two closing-profile parts together while the slider is moving in the direction of the arrow 33, so that the closing band is closed. When the slider is moved in the opposite direction (against the direction of the arrow 33), the core piece 1 separates the two profile parts to open the closing.

The back part of the slider 30, which faces the core piece 1, is held tight on the closing band only by short flanks or support flanks z, which project inward from the side parts 4 and 5. In this way, the slider 30 can slide over the closing profile at this place by expanding the side parts 4, 5 and tilting upward, which leads to a loss of function.

Figure 2:
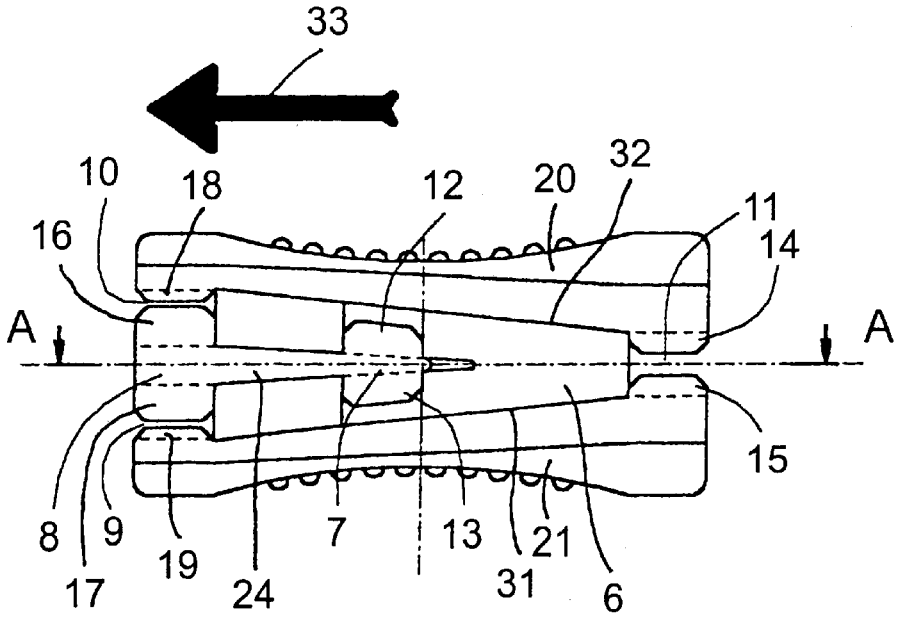
FIG. 2 shows a slider according to the invention is a top view from below.

FIG. 2 through 6 show a slider according to the invention. As can be seen in FIG. 2, another (second) core piece 7 is present there, which is located between the front (first, actual) larger core piece 8 and the back end of the slider. The additional core piece 7 is also located between the inner surfaces 31, 32. It has support flanks 12, 13 that project outward. In addition, the second core piece 7 is connected with core piece 8 through a thin bridge 24.

The outer end of the support flanks 16, 17 of core piece 8 are separated from the inner ends of the support flanks 18, 19 projecting inward from the side walls 20, 21. In this way, slits 9, 10 are formed for the halves of the closing band. At the end of the slider facing the core piece 8, there are support flanks 14, 15, which project inward from the inner surfaces 31, 32. The inner ends of the support flanks 14, 15 are at a distance from each other, whereby an opening 11 is formed.

In operation, the two halves of the closing band of the slider-closing band run separately through the two slits 9, 10 when the slider moves in the direction of the arrow 33. The halves of the closing are closed in the thin back part of the slider. The emerge from the opening 11 as a closed closing.

The additional, second, smaller core piece 7 holds the two profile parts of the slider-closing band by its side flanks 12, 13 also as far as the middle part of the slider and prevent the end of the slider facing core piece 8 from tilting upward. According to the invention, the halves of the slider-closing band are fed and held tight as far as the middle of the slider; they are then accepted by the narrower end of the slider. The slider is then still held on the closing band, which is now closed, by the smaller support flanks 14, 15. If the side parts 20, 21 of the slider are then to be bent away from each other by the slider being pulled, and the slider threatens to be tilt upward at its end facing away from core piece 8, the additional, smaller core piece 7 sill holds this slider tight on the closing band in the middle of the slider.

Figure 3:
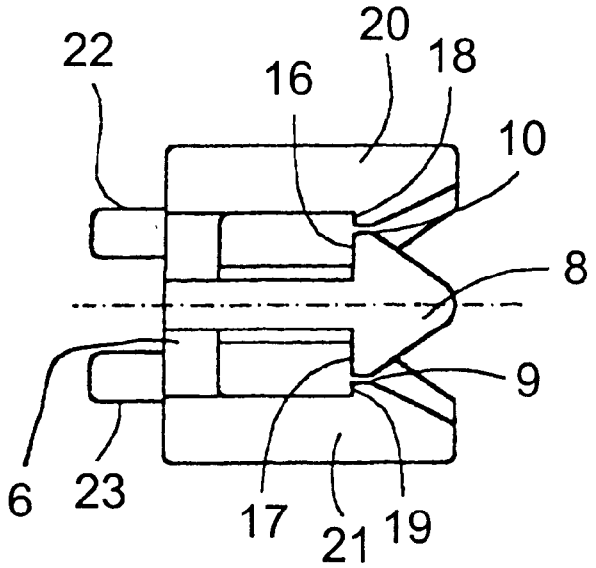
FIG. 3 shows the slider according to FIG. 2 in a front view (of the side of the slider shown in FIG. 2)

In FIG. 3, the slider according to FIG. 2 can be seen from the front (from the slits 9, 10), thus at the inlet to the two halves of the closing ban. The support flanks 16, 17 of core piece 8 hold the halves of the closing ban from the inside, while the support flanks 18, 19 of the side walls 20, 21 hold them tight on the slider from the outside.

Figure 7:
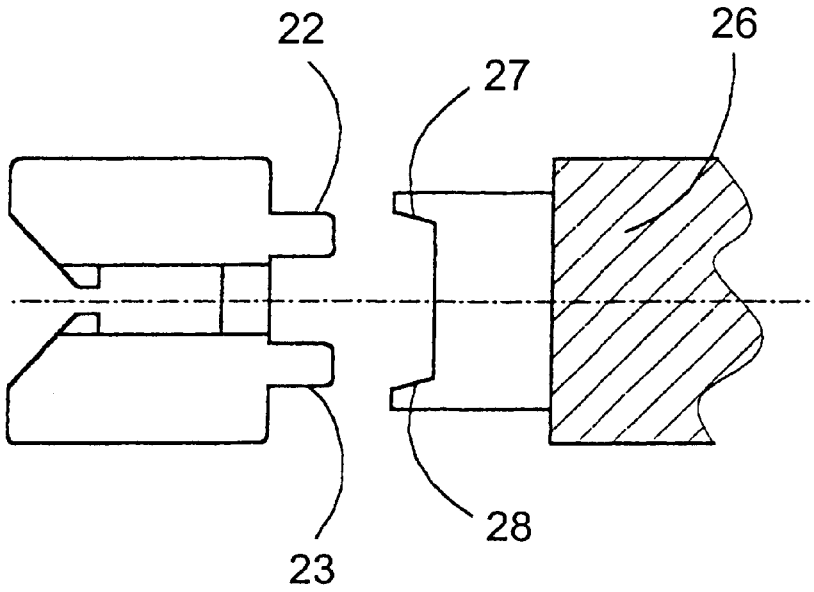
FIG. 7 shows the slider and a tappet, whereby the tappet is in a retracted position.
Figure 8:
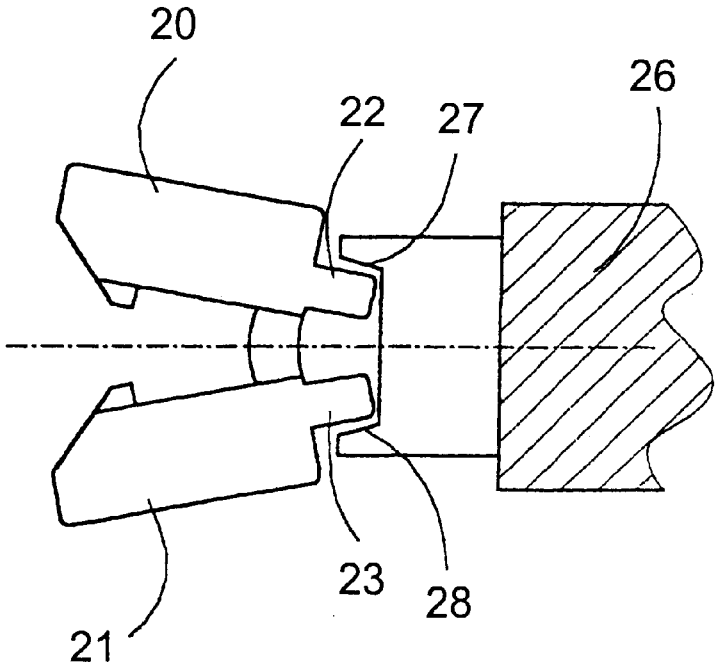
FIG. 8 shows the tappet when the slider is being pressed onto the closing band.

As can also be seen from FIG. 3, additions 22, 23 are provided at the upper part of the slider, thus at its base part 6, which have an essentially rectangular cross-section, which is rounded at the corners, however. These additions 22, 23 serve to spread the slider by means of a tappet, as shown in FIGS. 7 and 8.

Figure 4:
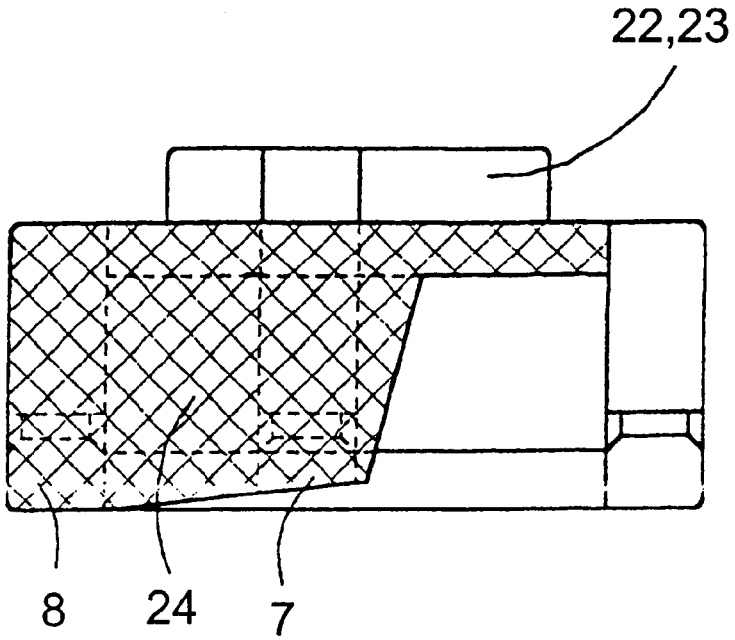
FIG. 4 shows a section along line A—A in FIG. 2.

FIG. 4 shows a cross-section along line A—A in FIG. 2. The core pieces 8 and 7 are connected to each other by a thin bridge 24.

Figure 5:
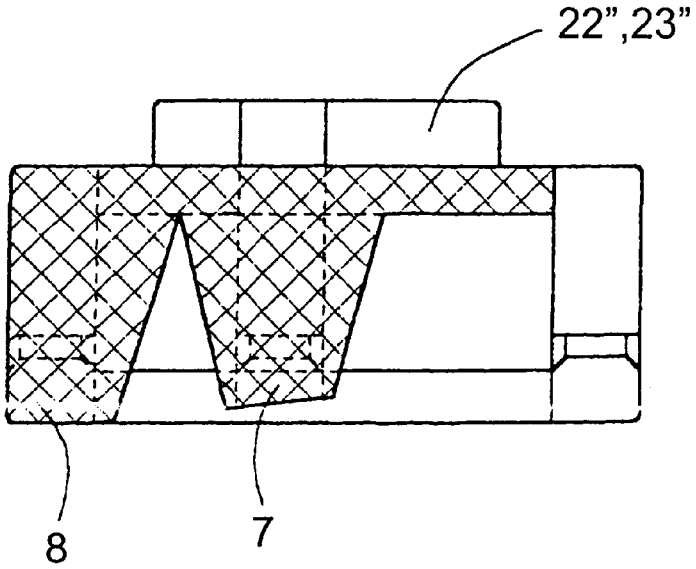
FIG. 5 shows an adapted embodiment, in which the additional smaller core piece is not connected to the first, larger core piece by a bridge.

In the improved embodiment shown in FIG. 5, the core pieces 8, 7 are not connected by a bridge, but separated from each other. This embodiment has the advantage that material is saved and that the side parts are easier to spread when the slider is moved upward.

Figure 6:
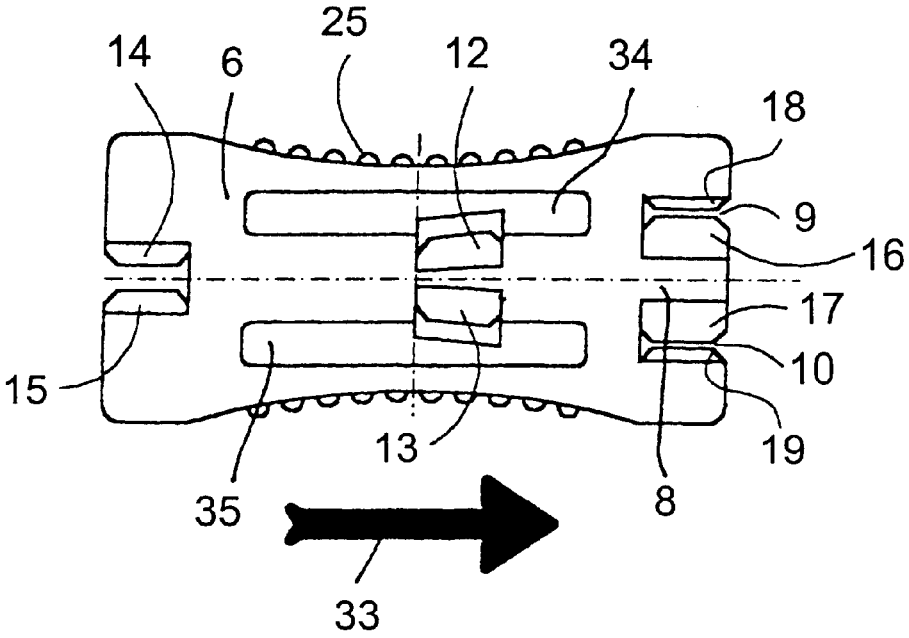
FIG. 6 shows the slider according to FIGS. 2 through 5 in a top view.

FIG. 6 shows the slider in a top view from above. Beside the closing-band inlet opening 9, 10, the support flanks 16, 17 of the (first, actual, larger) core piece 8 can be seen, as can the outer, smaller support flanks 18, 19 at the side parts 20, 21. At the (middle, smaller) other core piece 7, support flanks 12, 13 can be seen. The base part 6 have breaks 34, 35. At the end of the slider, from which the closed slider-closing band emerges, the small support flanks 14, 15 are located on the side parts 20, 21.

FIGS. 7 and 8 show the cooperation of the slider with a tappet 26 to spread the slider. The tappet 26 has projections 27, 28 at a distance from one another. The surface of the projections 27, 28 facing each other run at an angle to each other, specifically in such a way that the distance between these surfaces increases as the distance from the tappet 26 increases. In this way, inner surfaces of the projections facing each other form a conical indentation.

In the position shown in FIG. 7, the projections 27, 28 of the tappet 26 are separated by the additions 22, 23 of the slider. To slide the slider upward on the closing ban, the distance between the slider and the tappet 26 is reduced until the position shown in FIG. 8 is reached. When the tappet 26 is pushed forward, the inner surfaces of the projections 27, 28 mesh with the additions 22, 23. In this way, a pressure is exerted on the additions 22, 23, which then moves these additions 22, 23 toward each other in the manner shown in FIG. 8. In this way, the side walls 20, 21 of the slider spread apart somewhat, in the manner also shown in FIG. 8, so that the slider can be pressed more easily onto the closing band. Through the bending elasticity of the slider, the side walls 20, 21 spring back after being pressed; they then enclose the closing band.

The bending elasticity of the slider according to the invention is of significant importance for disturbance-free application. On the one hand, the slider must be pressed back into its starting position after being spread, on the other hand, this spreading must not be too difficult. In addition, the slider body should not become brittle during the spreading and for a long time thereafter. It should also not receive and tears. Finally, the slider, together with the closable purse and the slider-closing band must be reusable (recyclable).

In order to achieve this, the material must consist of the same or a similar material as the bag or the purse from which the slider-closing purse is produced. An especially suitable plastic material is low-pressure polyethylene (high-density polyethylene, HDPE), from which, together with high-pressure polyethylene (low-density polyethylene, LDPE) most bags and purses are produced and which recycles well. With this material, the HDPE slider can also be recycled, which means being ground and reused. Such a material is, for example, an HDPE form the company Borealis A/S, with a melt-flow rate of 12 g/10 min and a Shore hardness of 62.

The bending elasticity of the slider has been studied in numerous experiments and can be defined, e.g., as follows: tests at the slider end, starting from an end opening at 20-piece injection strand of 0.45 to 0.60 mm, measured at the free passage, including the outer, small support flanks 14, 15.

A slider is attached at both injected connecting sides of the chain by means of two clamps onto a spring balance, and a load is applied at the end opening in a tension test until it opens to the thickness of the closing band, about 1.8 mm at the ends, which mesh at the outer support flanks. 14, 15. This requires a tension load between 700 and 1300 grams. After the end of the tension load, a return of the end opening takes place at the slider to 0.9 to 1.0 mm, due to its elasticity.

The slider now permanently capable of functioning; this means that the closing band opens and closes securely, without becoming brittle or tearing. It then has a final opening of about 1.8 mm, less the outer support flanks surrounding the profile of about 0.4 mm each, thus about 1.0 mm, and the closing pressure lasts permanently.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A slider for a closing band, comprising:

a base part having two sidewalls, each of said two sidewalls including on a first end a first sidewall support flank that extends toward an opposing first sidewall support flank;

a first core piece extending downwardly from said base part adjacent said first end and between said two sidewalls of said base part, said first core piece having first core support flanks on a free end thereof, each first core support flank extending toward a respective one of said sidewall support flanks to define a slot thereabove, said slots for receiving halves of said closing band; and a second core piece extending downwardly from a middle part of said base part between said two sidewalls and having a free end extending beyond said closing band.

2. The slider as set forth in claim 1, wherein said first core piece is connected to said second core piece by a bridge.

3. The slider as set forth in claim 1, wherein said free end of said second core piece includes a pair of second core support flanks extending outwardly toward said sidewalls, said closing band being above said second core support flanks such that said second core support flanks prevent said first end of said slider from tilting upward as far as said middle part of said slider.

4. The slider as set forth in claim 1, further comprising a second sidewall support flank on each sidewall at a second end of said base part, said second sidewall support flanks extending toward one another to define a second slot thereabove, said halves of said closing band passing through said second slot joined together.

5. The slider as set forth in claim 4, wherein said sidewalls are closer to one another at said second end than at said first end.

6. The slider as set forth in claim 1, further comprising two projecting additions on an upper surface of said base part, each of said two additions associated with a respective one of said sidewalls for spreading said sidewalls apart from one another to ease placement of said slider over said closing band.

7. The slider as set forth in claim 6, wherein said slider is made of a plastic material with sufficient elasticity to permit said sidewalls to be spread in response to pressure applied to said projections and to spring back to enclose said closing band when said pressure is removed.

8. The slider as set forth in claim 7, wherein said sidewalls open approximately 1.8 mm at said second end in response to said pressure and spring back to an opening of approximately 0.9 mm.

9. A slider for a closing band joining two profile parts, comprising:

a base part having two sidewalls extending from a first end to a second end, each of said two sidewalls including a first sidewall support flank on said first end and a second sidewall support flank on said second end, said first and second sidewall support flanks projecting inwardly;

a first core piece extending downwardly from said first end between said first sidewall support flanks and having first core support flanks on a free end thereof, each first core support flank extending toward a respective one of said first sidewall support flanks to define a slot thereabove, each slot for receiving one of said two profile parts of said closing band; and a second core piece extending downwardly from said base part between said two sidewalls and having a free end extending downwardly beyond said closing band and a flange to hold said profile parts of said closing band thereabove to prevent said first end of said slider from tilting upward.

10. The slider as set forth in claim 9, wherein said free end of said second core piece includes a pair of second core support flanks extending outwardly toward said sidewalls, said closing band being above said second core support flanks.

11. The slider as set forth in claim 9, wherein said second sidewall support flanks extend toward one another to define a second slot thereabove, said profile parts of said closing band passing through said second slot joined together.

12. The slider as set forth in claim 11, wherein said sidewalls are closer to one another at said second end than at said first end.

13. The slider as set forth in claim 12, wherein said first core support flanks hold said profile parts on an inside thereof, and said first sidewall support flanks hold said profile parts on an outside thereof, said profile parts being separated from one another by said first core piece and said second core piece.

14. The slider as set forth in claim 12, wherein said second sidewall support flanks hold said profile parts of said closing band against one another on an outside of said profile parts.

15. The slider as set forth in claim 9, further comprising two projecting additions on an upper surface of said base part, each of said two additions associated with a respective one of said sidewalls for spreading said sidewalls apart from one another to ease placement of said slider over said closing band.

16. The slider as set forth in claim 15, wherein said slider is made of a plastic material with sufficient elasticity to permit said sidewalls to be spread in response to pressure applied to said projections and to spring back to enclose said closing band when said pressure is removed.

17. The slider as set forth in claim 16, wherein said slider, including said first core piece and said second core piece, is made of HDPE.

18. A slider for a closing band joining two profile parts, comprising:

a base part having two sidewalls extending from a first end to a second end;

a first core piece extending downwardly from said first end between said two sidewalls, said first core piece having support flanks on a free end thereof, each support flank extending toward a respective one of said sidewalls to define a slot above said support flank, each slot for receiving one of said two profile parts of said closing band; and a second core piece extending downwardly from a middle part of said base part between said two sidewalls, a free end of said second core piece extending downwardly beyond said closing band and having a flange to hold said profile parts of said closing band thereabove and prevent said first end of said slider from tilting upward at said middle part.

19. The slider as set forth in claim 18, wherein said free end of said second core piece includes a pair of core support flanks extending outwardly toward said sidewalls, said closing band being above said core support flanks.

20. The slider as set forth in claim 18, wherein each of said two sidewalls includes a first sidewall support flank on said first end and a second sidewall support flank on said second end, said first and second sidewall support flanks projecting inwardly, said first sidewall support flanks defining said slots with said support flanks, said second sidewall support flanks extending toward one another to define a second slot thereabove, said profile parts of said closing band passing through said second slot joined together.

* * * * *